US008204235B2

(12) United States Patent
Ohta

(10) Patent No.: US 8,204,235 B2
(45) Date of Patent: Jun. 19, 2012

(54) CENTER CHANNEL POSITIONING APPARATUS

(75) Inventor: Yoshiki Ohta, Sakado (JP)

(73) Assignee: Pioneer Corporation, Tokyo (JP)

( * ) Notice: Subject to any disclaimer, the term of this patent is extended or adjusted under 35 U.S.C. 154(b) by 245 days.

(21) Appl. No.: 12/743,643

(22) PCT Filed: Nov. 30, 2007

(86) PCT No.: PCT/JP2007/073201

§ 371 (c)(1),
(2), (4) Date: May 19, 2010

(87) PCT Pub. No.: WO2009/069228

PCT Pub. Date: Jun. 4, 2009

(65) Prior Publication Data

US 2010/0272269 A1 Oct. 28, 2010

(51) Int. Cl.
*H04R 5/00* (2006.01)

(52) U.S. Cl. ..... 381/27

(58) Field of Classification Search ..... 381/27, 381/19–23, 1, 17, 97, 307, 300
See application file for complete search history.

(56) References Cited

U.S. PATENT DOCUMENTS

2003/0031332 A1 2/2003 Tatsuta et al.
2004/0175001 A1 9/2004 Sakagami et al.
2005/0013442 A1 1/2005 Ohta
2006/0080089 A1* 4/2006 Vierthaler et al. ..... 704/208
2007/0002971 A1* 1/2007 Purnhagen et al. ..... 375/316
2007/0127733 A1* 6/2007 Henn et al. ..... 381/80
2007/0258607 A1* 11/2007 Purnhagen et al. ..... 381/307

FOREIGN PATENT DOCUMENTS

JP 63-269900 11/1988
JP 3-195199 8/1991
JP 2003-061198 2/2003
JP 2004-266604 9/2004
JP 2005-039311 2/2005

OTHER PUBLICATIONS

International Search Report, PCT/JP2007/073201, Jan. 15, 2008.

* cited by examiner

*Primary Examiner* — Hai Phan
(74) *Attorney, Agent, or Firm* — Young & Thompson

(57) ABSTRACT

A center channel positioning apparatus is provided, which does not cause strange feeling in sound quality even at a position apart from an original listener position.

A sound signal processing unit (40) changes a phase of at least one of a left sound signal for center channel positioning (CL) and a right sound signal for center channel positioning (CR), based on a processing coefficient, and causes a left speaker (46) and a right speaker (52) to output sound based on a center channel sound signal (C).

The processing coefficient is calculated based on the difference in level between both ears in the case where the left sound signal for center channel positioning (CL) for the left speaker (46), and the right sound signal for center channel positioning (CR) for the right speaker (52) are reproduced simultaneously.

5 Claims, 8 Drawing Sheets

CENTER CHANNEL POSITIONING APPARATUS

TECHNICAL FIELD

The present invention relates to a center channel positioning apparatus. In particular, the present invention relates to a center channel positioning apparatus which causes sound based on a center channel sound signal to be outputted from a left speaker and a right speaker.

BACKGROUND ART

Conventionally, in a surround system such as a 5.1-channel system, three speakers of a left speaker, a right speaker, and a center speaker are located in front of a listener, and it is desirable that the center speaker is located between the left speaker and the right speaker. However, since a display apparatus such as a television set is located between a left speaker and a right speaker, it is difficult that a center speaker is located between a left speaker and a right speaker.

Therefore, a surround system is proposed, in which a center speaker is omitted, and a center channel positioning based on a center channel sound signal is virtually formed by a left speaker and a right speaker.

In such a surround system mentioned above, a case will be mentioned, in which a center speaker is located in front of a listener position, and a left speaker is located with an angle of 30° in the left direction from the listener position, and a right speaker is located with an angle of 30° in the right direction from the listener position. A frequency characteristic in the case where a center channel sound signal is reproduced by left and right speakers is compared with a frequency characteristic in the case where the center channel sound signal is actually reproduced by a center speaker. In the case where a center channel sound signal is reproduced by left and right speakers, there is a problem that a gain is lowered by approximately 10 dB at a frequency band of approximately 1 to 4 kHz.

An apparatus for solving the above problem is shown, for example, in Patent Document No. 1.

Patent Document No. 1: Japanese Patent Laid-open No. 2004-266604

In a reproducing apparatus disclosed in Patent Document No. 1 mentioned above, after a center channel sound signal is processed by an equalizer in such a way that its frequency characteristic is corrected, the resultant signal is reproduced by left and right speakers. A characteristic of the equalizer is one which causes a frequency characteristic of a head transfer function in the case where a center channel sound signal is reproduced by left and right speakers to be equal to a frequency characteristic of a head transfer function in the case where the center channel sound signal is actually reproduced by a center speaker.

Concretely, at a frequency band of approximately 1 to 4 kHz, a level of frequency characteristic in the case where a center channel sound signal is reproduced by left and right speakers becomes lower than a level of frequency characteristic in the case where the center channel sound signal is actually reproduced by a center speaker, by approximately 10 dB. Therefore, an equalizer has a characteristic which causes a gain to be raised by approximately 10 dB at a frequency band of approximately 1 to 4 kHz.

DISCLOSURE OF THE INVENTION

Problem to be Solved by the Invention

In a reproducing apparatus disclosed in Patent Document No. 1 mentioned above, a correction characteristic of an equalizer is set on the assumption that in the case where a left speaker is located with an angle of 30° in the left direction from a listener position, and a right speaker is located with an angle of 30° in the right direction from the listener position, a center channel sound signal is heard at the listener position.

Therefore, in the case where a center channel sound signal is heard at a position apart from an original listener position, only a component of a frequency band of approximately 1 to 4 kHz for which a gain has been raised by approximately 10 dB, of components of a center channel sound signal, is heard. As a result, strange feeling in sound quality is caused to a listener.

The present invention has been achieved in view of the above problem, it is an example of an object of the invention to provide a center channel positioning apparatus which does not cause strange feeling in sound quality even at a position apart from an original listener position.

Means for Solving the Problem

In order to solve the above problem, the invention according to claim 1 relates to a center channel positioning apparatus, comprising:

- a sound signal outputting unit which outputs a left sound signal, aright sound signal, and a center channel sound signal,
- a sound signal processing unit which produces a left sound signal for center channel positioning, and a right sound signal for center channel positioning, based on the center channel sound signal,
- a left sound signal combining unit which combines the left sound signal with the left sound signal for center channel positioning to output a left combined sound signal to be supplied to a left speaker, and
- a right sound signal combining unit which combines the right sound signal with the right sound signal for center channel positioning to output a right combined sound signal to be supplied to a right speaker,
- wherein the sound signal processing unit changes a phase of at least one of the left sound signal for center channel positioning and the right sound signal for center channel positioning, based on a processing coefficient, and
- the processing coefficient is calculated based on the difference in level between both ears in the case where the left sound signal for center channel positioning and the right sound signal for center channel positioning are reproduced simultaneously, and the sum of power at both ears of the left sound signal for center channel positioning and the right sound signal for center channel positioning.

DESCRIPTION OF REFERENCE NUMERALS

Figure 1:
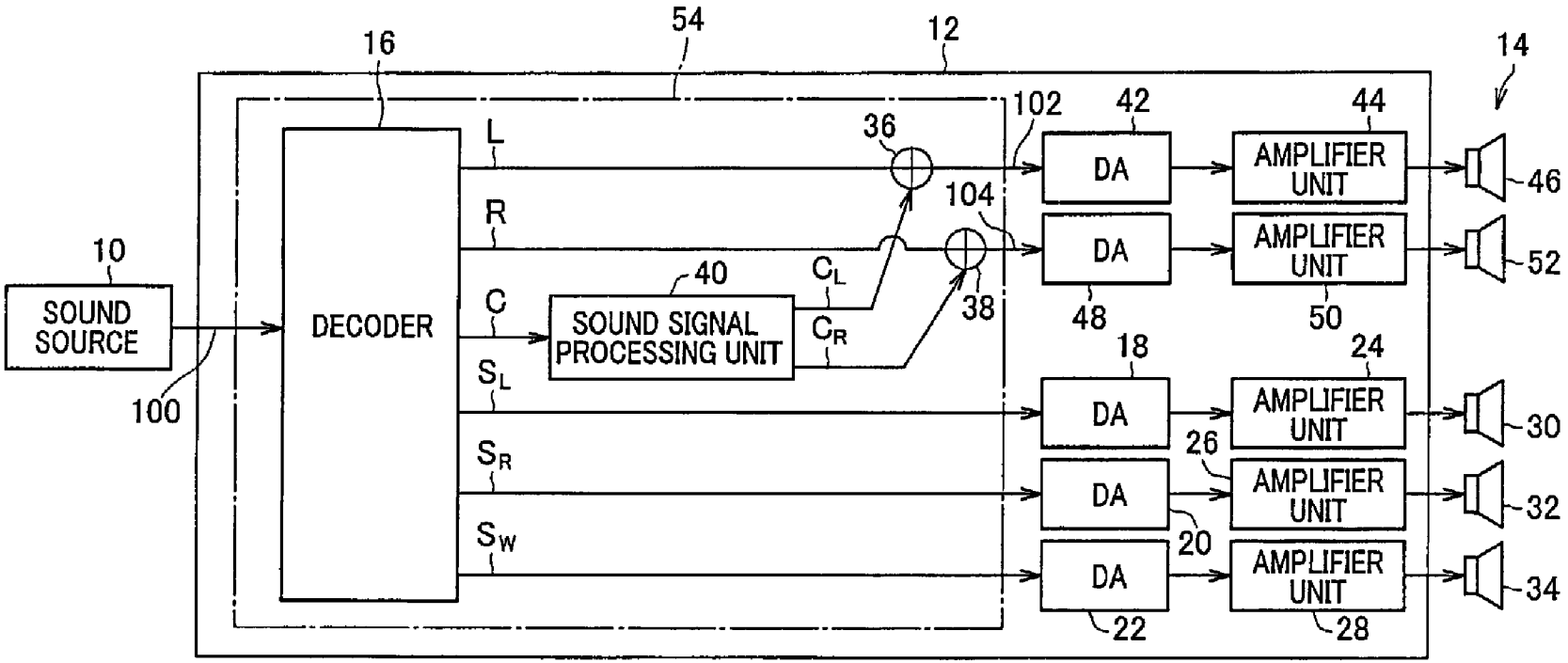
FIG. 1 is a block circuit diagram of a center channel positioning apparatus according to an embodiment of the invention.

10: sound source
12: AV amplifier device
14: speaker unit
16: decoder
36: left sound signal combining unit
38: right sound signal combining unit
40: sound signal processing unit
46: left speaker
48: right speaker
56: all-pass filter
C: center channel sound signal
CL: left sound signal for center channel positioning
CR: right sound signal for center channel positioning

BEST MODE FOR CARRYING OUT THE INVENTION

Referring now to FIG. 1 to FIG. 10, a best mode for carrying out the invention will be described.

In FIG. 1, a block circuit diagram of a center channel positioning apparatus according to an embodiment of the invention is shown.

In FIG. 1, a digital stream signal 100 from a sound source 10 such as a DVD player is supplied to an AV amplifier device 12, and a speaker unit 14 is connected to the AV amplifier device 12. Hereinafter, a structure of the AV amplifier device 12 is described.

The AV amplifier device 12 includes a decoder 16. The digital stream signal 100 is supplied to the decoder 16, and the decoder 16 decodes a signal of 5.1 ch. Surround signals SL, SR, and SW from the decoder 16 are supplied through DA conversion units 18, 20, and 22 to amplifier units 24, 26, and 28, respectively. Outputs from the amplifier units 24, 26, and 28 are supplied to surround speakers 30, 32, and 34 in the speaker unit 14.

The decoder 16 outputs a left sound signal L, aright sound R, and a center channel sound signal C. The left sound signal L, and the right sound R are supplied to a left sound signal combining unit 36, and a right sound signal combining unit 38, respectively. The center channel sound signal C is supplied to a sound signal processing unit 40, and based on the center channel sound signal C, the sound signal processing unit 40 produces a left sound signal for center channel positioning CL, and a right sound signal for center channel positioning CR, and supplies the sound signals CL and CR to the sound signal combining units 36, and 38, respectively. A structure of the sound signal processing unit 40 will be described later.

The left sound signal combining unit 36 combines the left sound signal L with the left sound signal for center channel positioning CL, and supplies a left combined sound signal 102 through a DA conversion unit 42, and an amplifier unit 44 to a left speaker 46 in the speaker unit 14. Similarly, the right sound signal combining unit 38 combines the right sound signal R with the right sound signal for center channel positioning CR, and supplies a right combined sound signal 104 through a DA conversion unit 48, and an amplifier unit 50 to aright speaker 52 in the speaker unit 14.

In the AV amplifier device 12, a block denoted by reference numeral 54 is composed of a processor such as a DSP, or a CPU which performs a digital process.

In a center channel positioning apparatus shown in FIG. 1, while the speaker unit 14 includes the left speaker 46, and the right speaker 52, it does not include a center speaker. Therefore, a center channel sound signal C from the decoder 16 is supplied to the sound signal processing unit 40, and based on the center channel sound signal C, the sound signal processing unit 40 is arranged to produce a left sound signal for center channel positioning CL, and a right sound signal for center channel positioning CR, and distribute the sound signals CL, and CR to the left speaker 46, and the right speaker 52, respectively.

Hereinafter, the sound signal processing unit 40 will be described.

Figure 2:
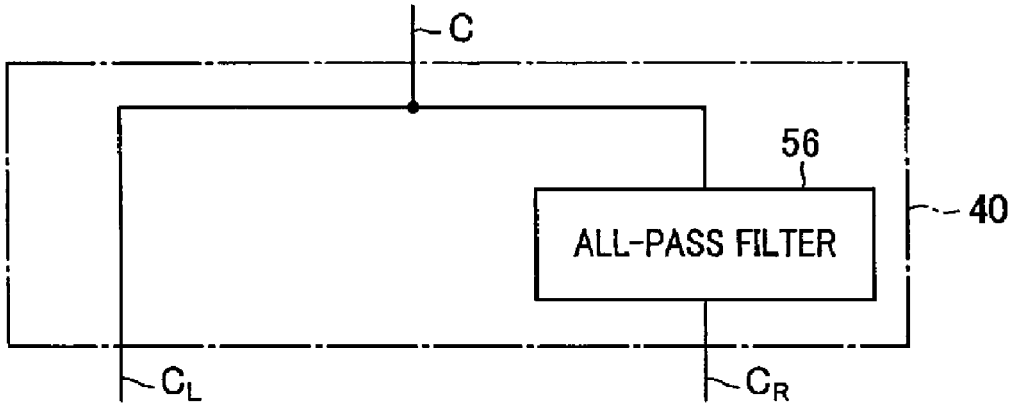
FIG. 2 is a circuit diagram showing a structure of the inside of a sound signal processing unit shown in FIG. 1.

In FIG. 2, a structure of the inside of a sound signal processing unit is shown.

In FIG. 2, the sound signal processing unit 40 produces a left sound signal for center channel positioning CL, and a right sound signal for center channel positioning CR, based on a center channel sound signal C. The sound signal processing unit 40 includes an all-pass filter 56 at the side of the right sound signal for center channel positioning CR. Here, the all-pass filter 56 is a filter whose amplitude characteristic for a frequency characteristic is flat, and which shifts only a phase. The sound signal processing unit 40 has a structure mentioned above. Therefore, while a phase of the right sound signal for center channel positioning CR is shifted, a phase of the left sound signal for center channel positioning CL is not shifted.

As mentioned above, by shifting a phase of the right sound signal for center channel positioning CR, sound based on a center channel sound signal C is outputted from a left speaker 46, and a right speaker 52.

Although a phase of the right sound signal for center channel positioning CR is shifted in the sound signal processing unit 40 shown in FIG. 2, it may be possible to shift a phase of the left sound signal for center channel positioning CL.

As mentioned above, the sound signal processing unit 40 shifts a phase of the right sound signal for center channel positioning CR, or a phase of the left sound signal for center channel positioning CL. Here, the sound signal processing unit shifts a phase based on a processing coefficient. The processing coefficient may be fixed or variable. Hereinafter, a case where the processing coefficient is variable will be described.

The processing coefficient depends on an arrangement of a speaker, such as a space between a left speaker and a right speaker, a distance from a speaker to a listener. It is possible to change a processing coefficient based on an arrangement of a speaker. An arrangement for such a change is shown in FIG. 3.

Figure 3:
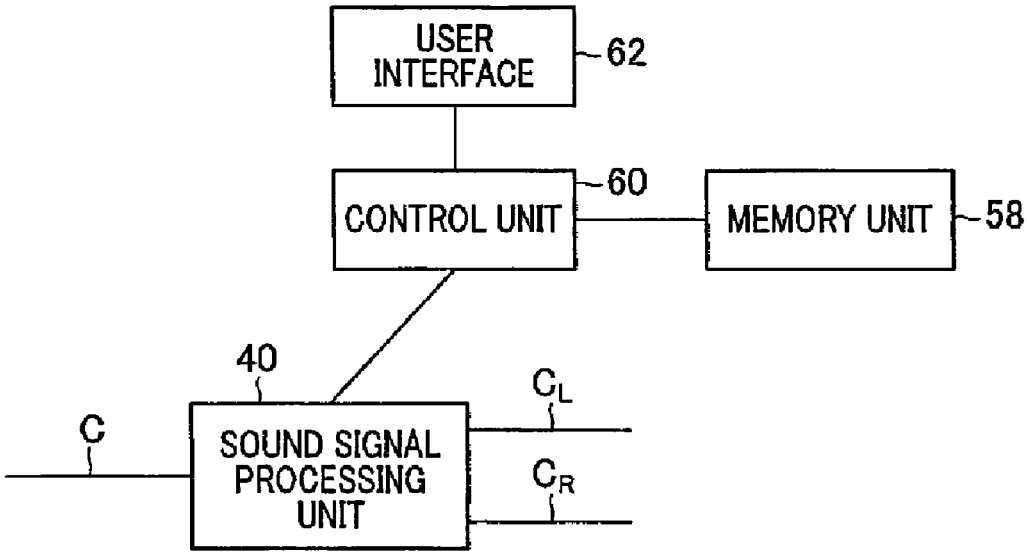
FIG. 3 is a circuit diagram showing an input of a sound signal processing unit shown in FIG. 1.

In FIG. 3, an input of a sound signal processing unit is shown.

In FIG. 3, a memory unit 58 stores a plurality of different processing coefficients, and a control unit 60 selects a proper processing coefficient from the memory unit 58, and supplies it to the sound signal processing unit 40 in accordance with instructions from a user interface 62. That is, when a user inputs information concerning an arrangement of a speaker, to the user interface 62, the control unit 60 selects a proper processing coefficient for the arrangement of the speaker, from the memory unit 58, and supplies it to the sound signal processing unit 40.

Figure 4:
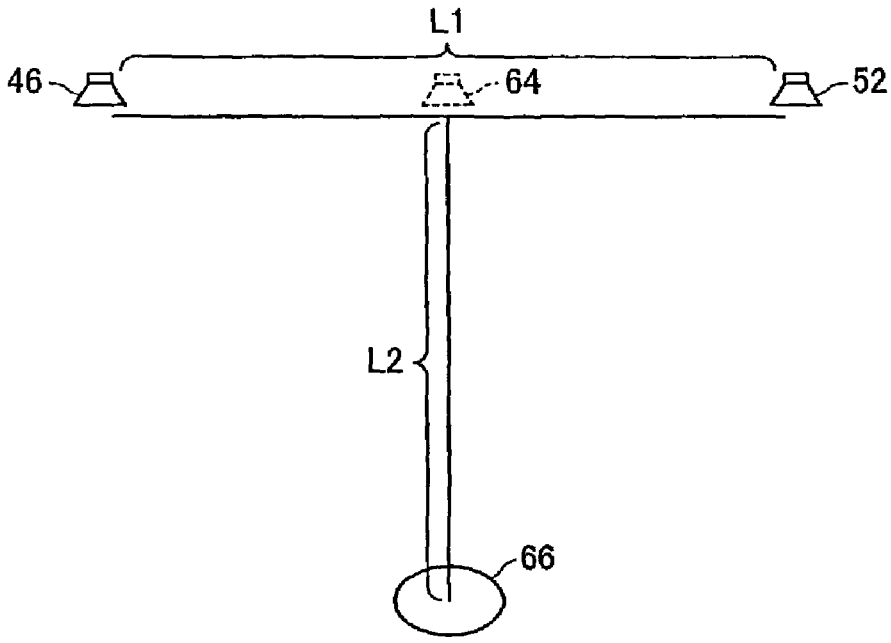
FIG. 4 is a view of arrangement showing the relationship in position between a listener, and a left speaker and a right speaker.

Now, in FIG. 4, the relationship in position between a listener, and a left speaker and a right speaker is shown.

In an arrangement of speaker in FIG. 4, a space L1 between a left speaker 46 and a right speaker 52 is 1.5 m, and a center speaker 64 is shown by a broken line between both of the speakers 46 and 52. Although the center speaker 64 is not actually arranged, it is virtually shown just for the convenience of explanation. A distance L2 from a line connecting both of the speakers 46 and 52 to a listener 66 is 2 m.

Figure 5:
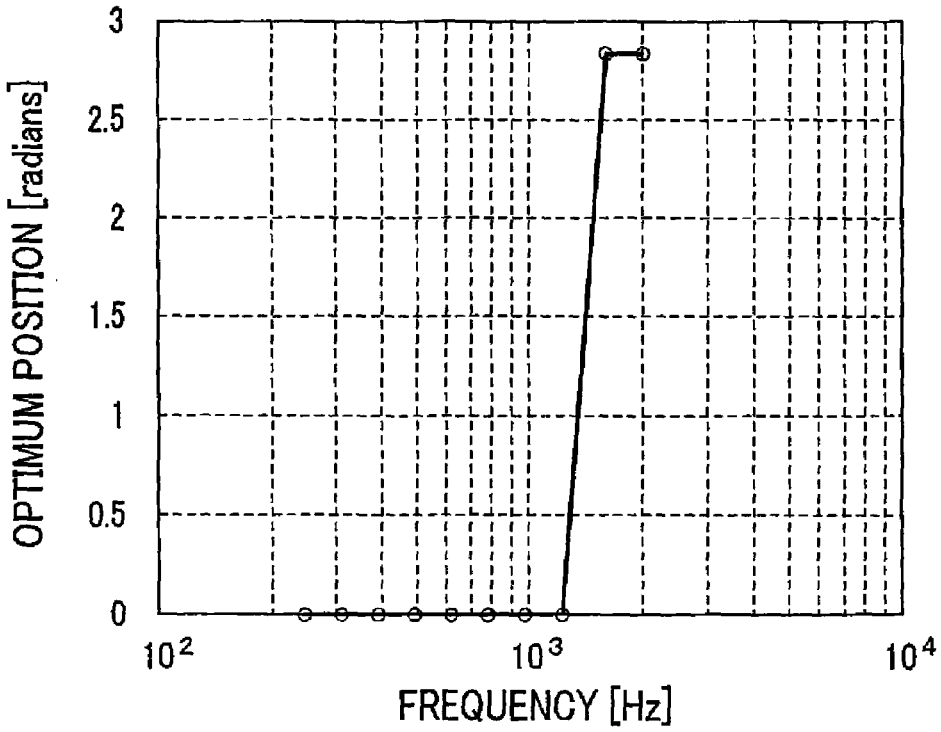
FIG. 5 is a view of graph showing an amount of delay for each band in an all-pass filter.

In the case where the left speaker 46 and the right speaker 52 are arranged as shown in FIG. 4, an all-pass filter 56 in a sound signal processing unit 40 delays an input signal only around a band of 2 KHz by approximately π (pi) radian (namely, a delay of approximately a half of wavelength), and causes a delay of phase of input signal to be 0 radian (namely, no delay) at a band of low frequency, and around a band of 2 KHz and more, as shown in FIG. 5.

As mentioned above, FIG. 5 shows an amount of delay of phase for each band in an all-pass filter 56.

Hereinafter, a process of deriving an amount of delay of phase at each band shown in FIG. 5 will be described.

Figure 6:
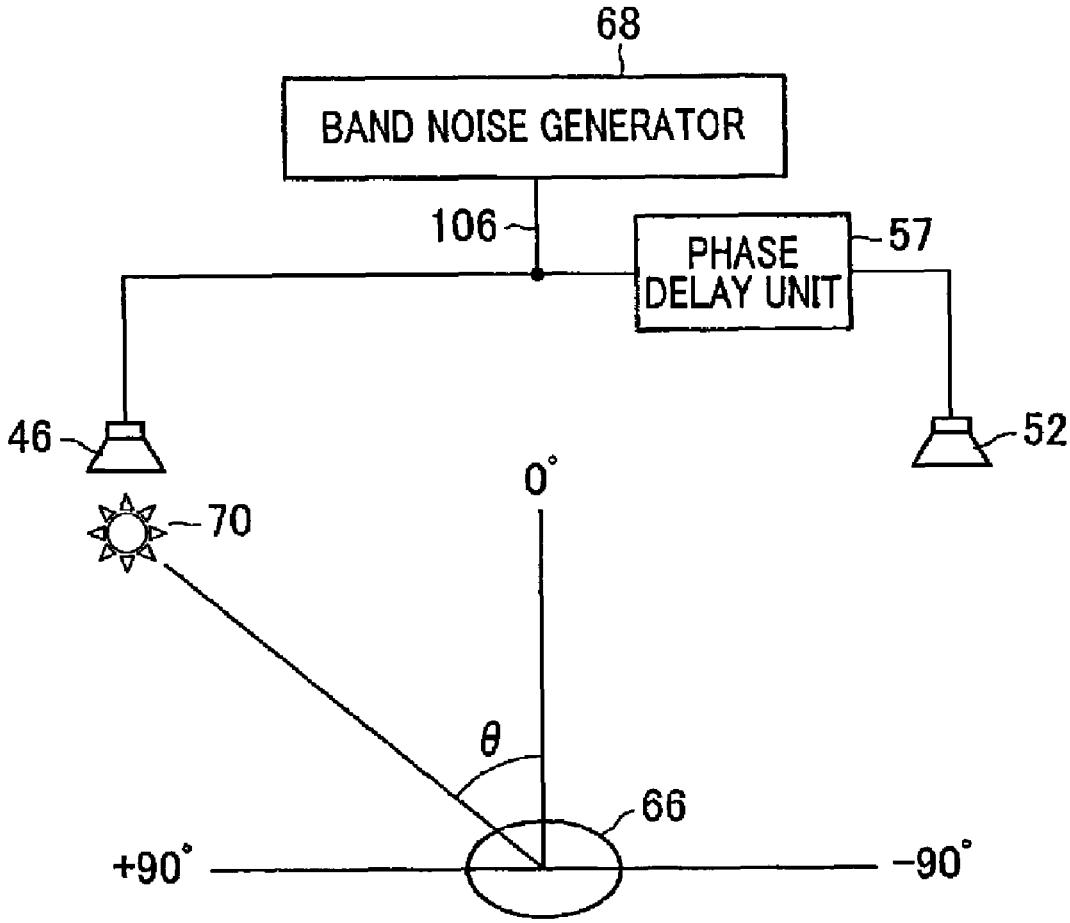
FIG. 6 is a view of arrangement showing the relationship in position between a listener, and a left speaker and a right speaker, in the case where a subjective evaluation experiment is conducted.

In FIG. 6, a listener 66, and a left speaker 46 and a right speaker 52 are arranged similarly with FIG. 4, and a subjective evaluation experiment has been conducted.

In FIG. 6, a band noise generator 68 outputs a band noise signal 106 (a width of band: ⅓ octave). The band noise signal 106 is supplied to a left speaker 46 without a change of phase, and is supplied to a right speaker 52 after a delay of phase at a phase delay unit 57. In the case where an amount of delay of phase in an all-pass filter 56 is changed, it has been investigated in which direction a sound image 70 is positioned relative to a listener 66. In FIG. 6, a direction of the sound image 70 is denoted by a degree of θ (theta). The result of the experiment is shown in a graph of FIG. 7.

Figure 7:
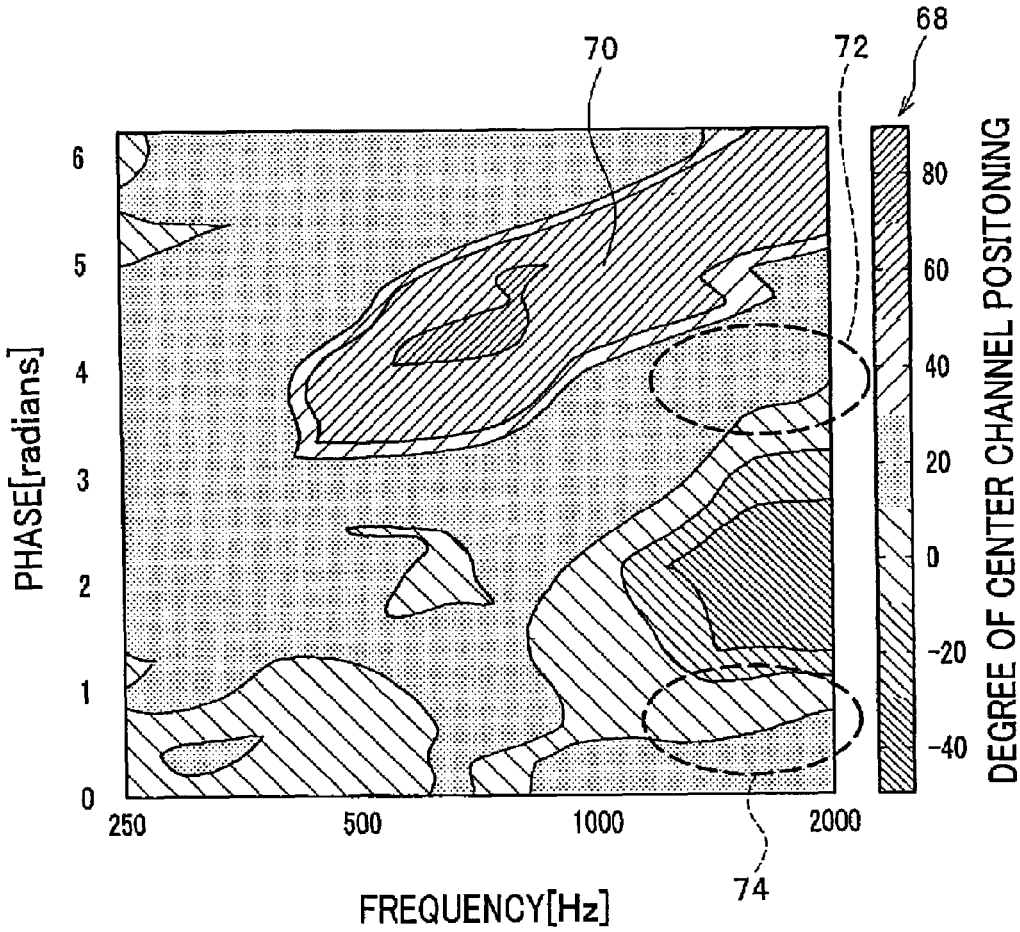
FIG. 7 is a view of graph showing a result of a subjective evaluation in a center channel positioning.

FIG. 7 shows how a center channel positioning is changed, namely, how a degree of a center channel positioning is changed, in the case where an amount of delay of phase is changed at each band. A bar-shaped indicator 68 on the right side in FIG. 7 shows that an indication in each area in a graph of FIG. 7 corresponds to what degree of a center channel positioning. For example, in an area 70 in a graph of FIG. 7, it is noticed from the indicator 68 that a degree of a center channel positioning is approximately 80 degree (namely, a sound image is positioned approximately laterally).

In FIG. 7, in an area other than around an area of 2 KHz, since a degree of phase is 0 radian, and a degree of a center channel positioning is 0 degree (namely, positioned right in front), it is selected that a degree of phase is made 0 radian in the area (namely, a phase is not delayed).

On the other hand, around an area of 2 KHz, there exist two phases whose degree of a center channel positioning is 0 degree. That is, around an area of 2 KHz, in two areas 72 (a degree of phase: π(pi) radian) and 74 (a degree of phase: 0 radian) which are denoted by a broken line, a degree of center channel positioning is 0 degree. Therefore, it is possible to select the two areas 72 (a degree of phase: π(pi) radian) and 74 (a degree of phase: 0 radian). However, the area 72 (a degree of phase: π(pi) radian) is selected for the following reason.

Figure 8:
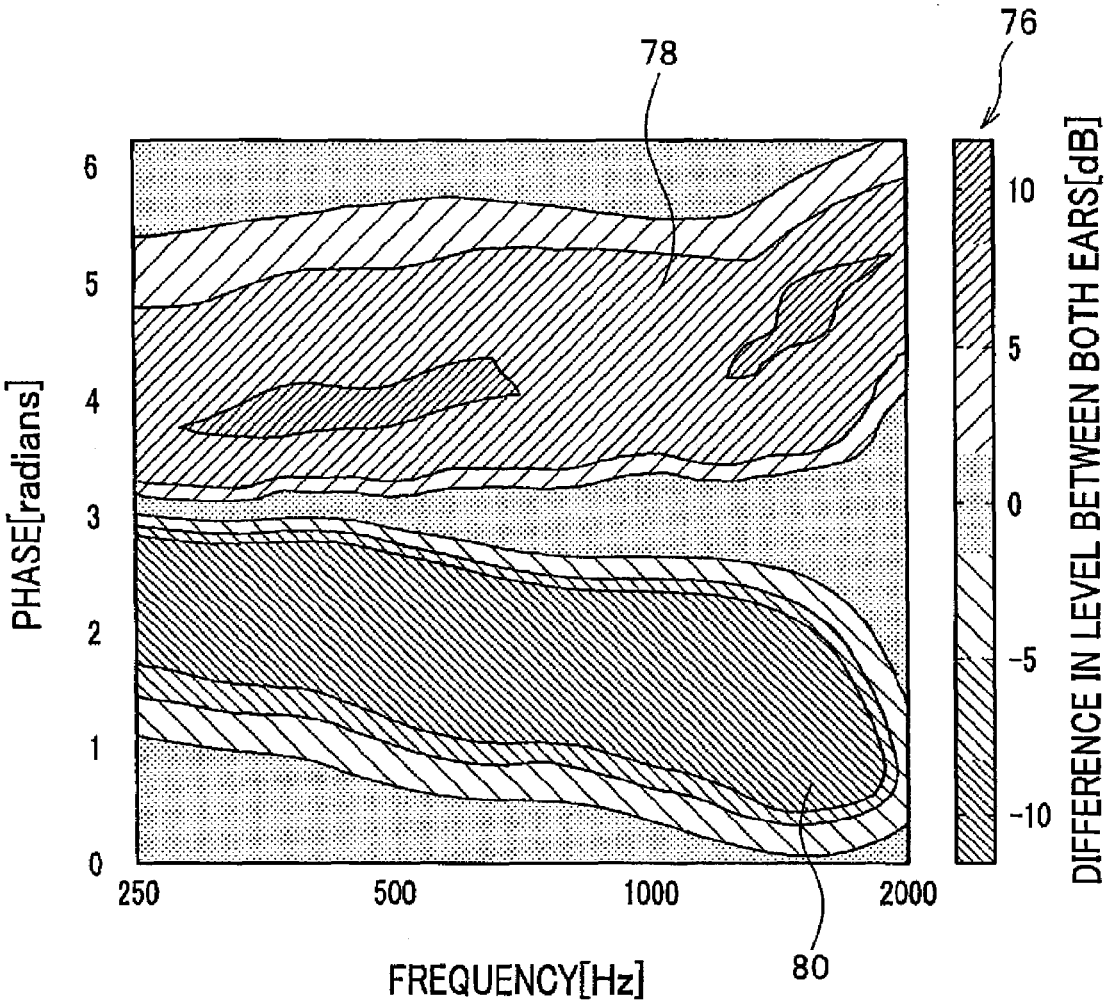
FIG. 8 is a view of graph showing the difference in level between both ears.

First, FIG. 8 shows the difference in level between both ears, namely, shows the result of measure of the difference in level between both ears in the case where a dummy head microphone is located at a listening position.

A bar-shaped indicator 76 on the right side in FIG. 8 shows that an indication in each area in a graph of FIG. 8 corresponds to what degree of the difference in level between both ears. For example, in an area 78 in a graph of FIG. 8, it is noticed from the indicator 76 that the difference in level between both ears is approximately 10 dB (a level of sound pressure is big at a left ear), while in an area 80, it is noticed from the indicator 76 that the difference in level between both ears is approximately −10 dB (a level of sound pressure is big at aright ear).

In FIG. 8, it is noticed that an area in which the difference in level between both ears is 0 which is ideal is an area whose phase is around 0, π(pi), or π(pi) radian.

Figure 9:
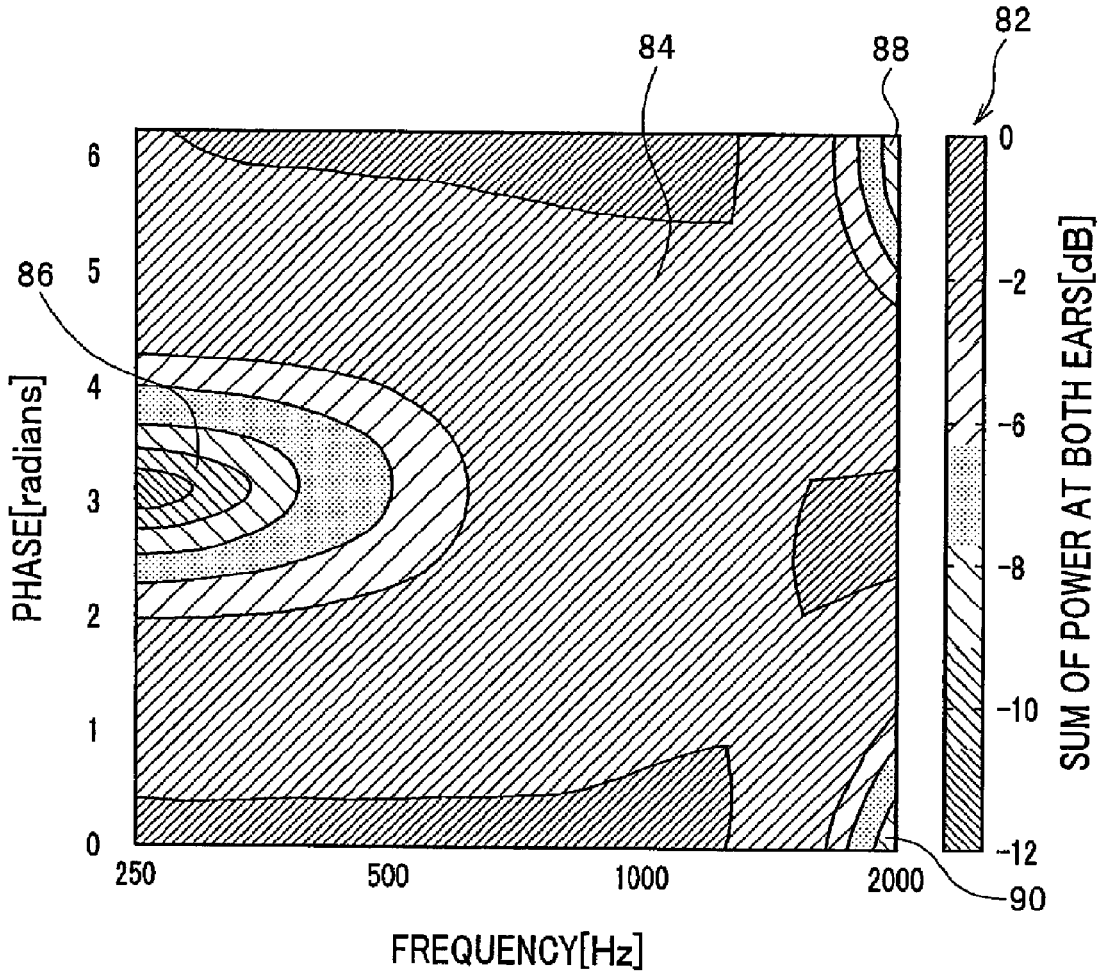
FIG. 9 is a view of graph showing the attenuation of sum of power at both ears.

Now, FIG. 9 shows the sum of power at both ears, namely, shows the result of measure of the sum of power at both ear in the case where a dummy head microphone is located at a listening position.

A bar-shaped indicator 82 on the right side in FIG. 9 shows that an indication in each area in a graph of FIG. 9 corresponds to what degree of the sum of power at both ears. An maximum of the sum of power is normalized to 0 dB. For example, in an area 84 in a graph of FIG. 9, it is noticed from the indicator 82 that the sum of power at both ears is approximately −2 dB.

In FIG. 9, around an area of 250 Hz, it is noticed that when a phase is approximately π(pi) radian, the sum of power at both ears is lowered (see an area 86). On the other hand, around an area of 2 KHz, it is noticed that when a phase is approximately 0 radian and approximately 2π(pi) radian, the sum of power at both ears is lowered (see an area 88 and an area 90).

From graphs of FIG. 8 and FIG. 9 mentioned above, an ideal phase is selected for each band. That is, a phase is selected for each band in such a way that the difference in level between both ears is maintained around 0 from a graph of a FIG. 8, and the sum of power at both ears is not lowered from a graph of a FIG. 9. When such a selection is made, a concept of degree of center positioning is used, and a degree of center positioning is defined by the following equation for evaluation.

(a degree of center positioning)=(1/(an absolute value of the difference in level between both ears))* (the sum of power at both ears)*(the weight of phase)

The degree of center positioning is calculated for each band. When a phase is changed for each band, an absolute value of the difference in level between both ears, and the sum of power at both ears change. At this time, (1/(an absolute value of the difference in level between both ears), and (the sum of power at both ears) are set to be normalized in such a way that they change between 0 and 1, respectively.

Further, the weight of phase is added, because it is desirable that a change of phase is as small as possible. That is, the weight of phase is set to change linearly with a phase in such a way that the weight of phase is a value of 1 when a phase is 0 radian, and the weight of phase is a value of 0 when a phase is 2π(pi) radian.

As mentioned above, since (1/(an absolute value of the difference in level between both ears)), (the sum of power at both ears), and (the weight of phase) change between 0 and 1, a degree of center positioning changes between 0 and 1.

Figure 10:
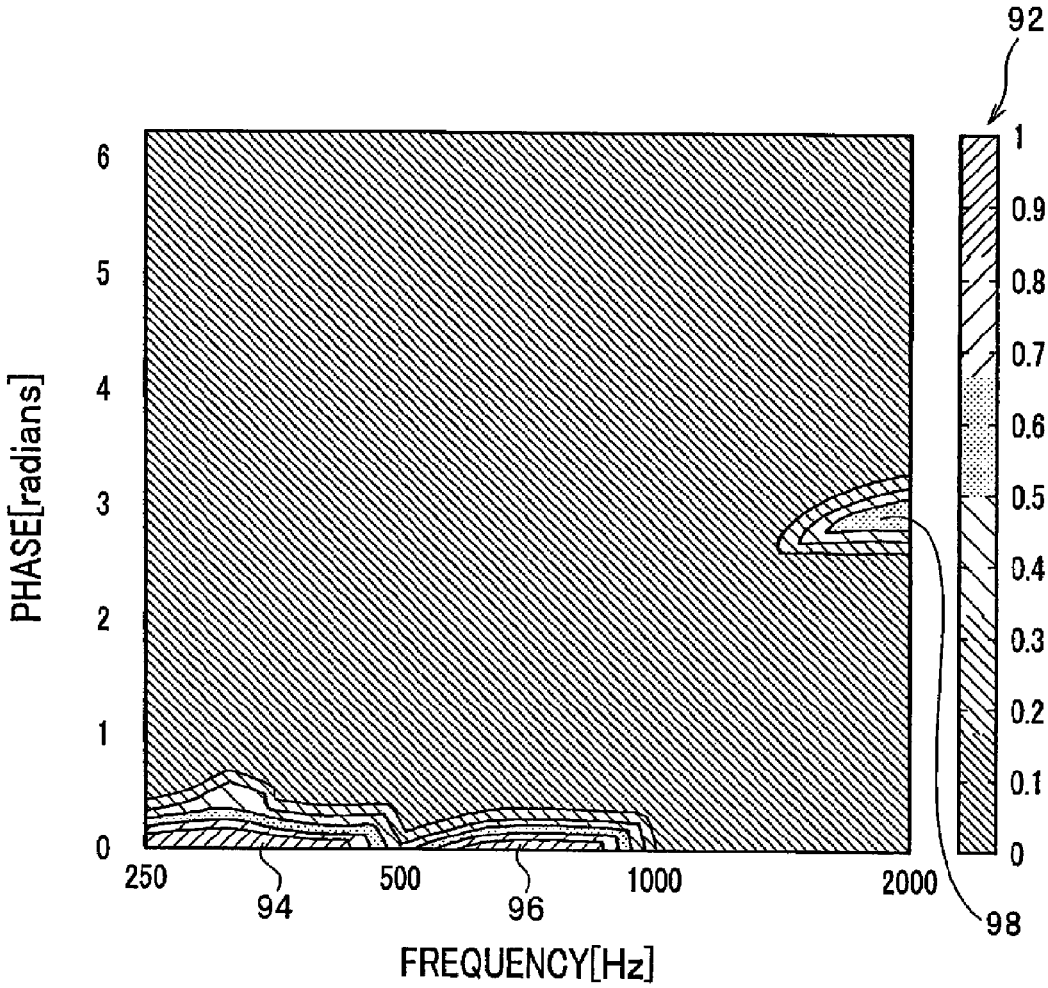
FIG. 10 is a view of graph showing a degree of center positioning.

Now, FIG. 10 is a view of graph showing a degree of center positioning.

A bar-shaped indicator 82 on the right side in FIG. 10 shows that an indication in each area in a graph of FIG. 10 corresponds to what degree of center positioning. For example, in an area 94 and an area 96 in a graph of FIG. 10, from the indicator 92, a degree of center positioning is approximately 1, and in an area 98 in a graph of FIG. 10, from the indicator 92, a degree of center positioning is approximately 0.5. From a graph of FIG. 10, in order for a degree of center positioning to approach as 1 as possible, π(pi) radian is selected as a phase at a band of approximately 2 KHz, and 0(pi) radian is selected as a phase at a band other than approximately 2 KHz. A phase for each band thus selected corresponds to a graph of FIG. 5 mentioned above.

As one embodiment of the present invention, a center channel positioning apparatus is used only for a band of frequency of approximately 1 KHz to approximately 4 KHz. Hereinafter, this embodiment will be described hereinafter.

As mentioned in an column of "BACKGROUND ART" of this specification, in a frequency band of approximately 1 to approximately 4 kHz, a level of frequency characteristic in the case where a center channel sound signal is reproduced by left and right speakers becomes lower than a level of frequency characteristic in the case where the center channel sound signal is actually reproduced by a center speaker, by approximately 10 dB. Therefore, in the embodiment, a center channel positioning apparatus is used only for a band of frequency of approximately 1 KHz to approximately 4 KHz. Consequently, strange feeling in sound quality is not caused for a listener.

This embodiment has an advantageous effect that strange feeling in sound quality is not caused for a listener, because an arrangement is one in which a phase is changed, even if a center channel sound signal is heard at a position apart from an original listener position, as compared with an arrangement mentioned in Patent document No. 1 in which a gain is raised, i.e., a frequency characteristic is changed.

The present invention is not limited to the foregoing embodiment. The embodiment is illustrative. Anything having substantially the same configuration and producing similar effects as the technical ideas described in the scope of claims of the present invention is included in the technical scope of the present invention.

The invention claimed is:

1. A center channel positioning apparatus, comprising:

a sound signal outputting unit which outputs a left sound signal, a right sound signal, and a center channel sound signal, a sound signal processing unit which produces a left sound signal for center channel positioning, and a right sound signal for center channel positioning, based on the center channel sound signal, a left sound signal combining unit which combines the left sound signal with the left sound signal for center channel positioning to output a left combined sound signal to be supplied to a left speaker, and a right sound signal combining unit which combines the right sound signal with the right sound signal for center channel positioning to output a right combined sound signal to be supplied to a right speaker, wherein the sound signal processing unit changes a phase of at least one of the left sound signal for center channel positioning and the right sound signal for center channel positioning, based on a processing coefficient, and the processing coefficient is calculated based on the difference in level between both ears in the case where the left sound signal for center channel positioning and the right sound signal for center channel positioning are reproduced simultaneously, and the sum of power at both ears of the left sound signal for center channel positioning and the right sound signal for center channel positioning.

2. A center channel positioning apparatus according to claim 1, wherein the processing coefficient is further calculated based on the weight of phase, and the weight of phase indicates a change of phase of the left sound signal for center channel positioning, or the right sound signal for center channel positioning.

3. A center channel positioning apparatus according to claim 1, wherein the sound signal processing unit is composed of an all-pass filter.

4. A center channel positioning apparatus according to claim 1, further comprising a speaker unit including a left speaker and a right speaker, wherein the processing coefficient is changed based on an arrangement of the left speaker and the right speaker of the speaker unit.

5. A center channel positioning apparatus according to claim 1, wherein the phase is changed only at a band of frequency of 1 KHz to 4KHz.

* * * * *